US007845520B2

(12) United States Patent
Clark et al.

(10) Patent No.: US 7,845,520 B2
(45) Date of Patent: Dec. 7, 2010

(54) MOUNTING PLATE AND KIT TO PROVIDE WATER RESISTANCE FOR A DISPENSER

(75) Inventors: Gerald Lewis Clark, Nicholson, GA (US); David W. Kapiloff, Gainesville, GA (US); Ronald Lynn Beal, II, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 1225 days.

(21) Appl. No.: 11/080,695

(22) Filed: Mar. 15, 2005

(65) Prior Publication Data

US 2006/0208129 A1 Sep. 21, 2006

(51) Int. Cl.
*B67D 7/06* (2010.01)

(52) U.S. Cl. ..... 222/181.3; 312/245; 248/309.1; 248/346.5

(58) Field of Classification Search ..... 248/681, 248/115, 309.1, 315, 309.2, 346.04, 346.5; 220/180; 312/245, 296; 222/180, 181.3
See application file for complete search history.

(56) References Cited

U.S. PATENT DOCUMENTS 3,540,630 A * 11/1970 Brown et al. ..... 222/153.03
4,146,156 A * 3/1979 Cassia ..... 222/181.2
4,461,445 A * 7/1984 Williamson et al. ..... 248/551
5,226,625 A * 7/1993 Hanna ..... 248/222.13
6,962,272 B2 * 11/2005 LeBlond ..... 222/180
7,201,354 B1 * 4/2007 Lee ..... 248/231.9
2003/0077144 A1 * 4/2003 Perrot ..... 411/349
2006/0163285 A1 * 7/2006 Gerenraich ..... 222/180

* cited by examiner

*Primary Examiner*—Terrell McKinnon
*Assistant Examiner*—Bradley H Duckworth
(74) *Attorney, Agent, or Firm*—Ralph H. Dean, Jr.

(57) ABSTRACT

An apparatus adapted for use with a dispenser to render the dispenser water resistant is provided. The dispenser for which it is provided has a housing including a compartment formed therein, an exit port, and a back housing portion including at least one aperture therein. The apparatus comprises a mounting plate configured to be mounted to a vertical surface. The mounting plate includes at least one rotational key extending therefrom. When at least a portion of the back housing portion of the dispenser is positioned against the mounting plate, the key is positioned to extend through the aperture in the back housing portion. The dispenser is releasably coupled against the mounting plate when the key is rotated such that it is not aligned with the aperture through which it extends, thereby holding the housing against the mounting plate. A kit may be provided which includes the mounting plate. A system including the mounting plate and a dispenser may be provided.

26 Claims, 6 Drawing Sheets

MOUNTING PLATE AND KIT TO PROVIDE WATER RESISTANCE FOR A DISPENSER

BACKGROUND

Dispensers of products in certain commercial settings may be washed down by spraying the entire area, including walls, ceiling, floor, and any apparatus therein, with a water and/or a liquid cleaning solution to prevent the inadvertent spread of bacteria and/or disease. When dispensers are in such a commercial setting, the water and/or liquid cleaning solution may be sprayed at high pressures and may leak into the dispensers, resulting in products disposed in the dispenser, such as, for example, sheet material, that becomes wet. This results in jamming of wet products in the dispenser and waste of products when such wet products must be removed and disposed of by maintenance personnel. Further, components in the dispenser may become rusted and/or caked with dried cleaning solution which has leaked inside. The dispenser is less likely to operate properly to dispense products after liquid cleaning solution leaks into the dispenser. Water and/or liquid cleaning solution which leaks inside the dispenser may carry bacteria or other pathogens as well.

There is a need for an easy way to provide water or liquid resistance to a standard dispenser. Such resistance would desirably prevent or greatly reduce liquids such as water of liquid cleaning solution from entering the dispenser, thereby eliminating or reducing wet products therein. Further, such resistance would prevent or reduce contamination to the products by agents, such as, for example, bacteria, which enter via the liquid into the dispenser. Moreover, poor dispensing performance of the dispenser due to such leakage would also be reduced or eliminated. Such water or liquid resistance would enhance the ability of maintenance personnel to clean a commercial area thoroughly, as required by some standards, such as HACCP. Such resistance would enhance the ability of the dispenser to provide clean, uncontaminated products therefrom, such as, for example, sheet material.

DEFINITIONS

As used herein, the term "exit port" or "dispensing port" is the opening in a housing of a dispenser for the passage of sheet material out of the dispenser.

As used herein, the term "sheet material" means a material that is thin in comparison to its length and breadth. Generally speaking, sheet materials should exhibit a relatively flat planar configuration and be flexible to permit folding, rolling, stacking, and the like. Exemplary sheet materials include, but are not limited to, paper tissue, paper towels, label rolls, or other fibrous, film, polymers, or filamentary products.

As used herein, the term "fasteners" means devices that fasten, join, connect, secure, hold, or clamp components together. Fasteners include, but are not limited to, screws, nuts and bolts, rivets, snap-fits, tacks, nails, loop fasteners, and interlocking male/female connectors, such as fishhook connectors, a fish hook connector includes a male portion with a protrusion on its circumference. Inserting the male portion into the female portion substantially permanently locks the two portions together.

As used herein, the term "hinge" refers to a jointed or flexible device that connects and permits pivoting or turning of a part to a stationary component. Hinges include, but are not limited to, metal pivotable connectors, such as those used to fasten a door to frame, and living hinges. Living hinges may be constructed from plastic and formed integrally between two members. A living hinge permits pivotable movement of one member in relation to another connected member.

As used herein, the term "couple" includes, but is not limited to, joining, connecting, fastening, linking, or associating two things integrally or interstitially together.

As used herein, the term "HACCP" stands for Hazard Analysis and Critical Control Point, a food safety program adopted by the Food and Drug Administration.

The term "water" as used herein refers to any fluid in liquid form.

These terms may be defined with additional language in the remaining portions of the specification.

SUMMARY OF THE INVENTION

In response to the difficulties and problems discussed above, an apparatus adapted for use with a dispenser to render the dispenser water resistant is provided. The apparatus is used with a dispenser which has a housing including a compartment formed therein, an exit port, and a back housing portion including at least one aperture therein. The apparatus comprises a mounting plate configured to be mounted to a vertical surface. The mounting plate includes at least one rotational key extending therefrom. When at least a portion of the back housing portion of the dispenser is positioned against the mounting plate, the key is positioned to extend through the aperture in the back housing portion. The dispenser is releasably coupled against the mounting plate when the key is rotated such that it is not aligned with the aperture through which it extends, thereby holding the housing against the mounting plate.

In another aspect of the invention, a kit adapted for use with a dispenser to render the dispenser water resistant is provided. The kit is used with a dispenser having a housing including a compartment formed therein, an exit port, and a back housing portion including at least one aperture. The kit comprises at least a mounting plate configured to be mounted to a vertical surface. The mounting plate includes at least one rotational key extending therefrom. When the dispenser is aligned and positioned against the mounting plate, the key extends through an aperture in the back housing portion. The dispenser is releasably coupled against the mounting plate when the key is rotated such that it is not aligned with the aperture through which it extends, thereby holding the housing against the mounting plate.

In yet another aspect of the invention, a system adapted to render a dispenser water resistant is provided, and it comprises a mounting plate configured to be mounted to a vertical surface. The mounting plate includes at least one rotational key. The system also includes a dispenser having a housing including a compartment formed therein, an exit port, and a back housing portion including at least one aperture therein configured to receive the rotational key. When the dispenser is positioned against the mounting plate and the aperture is aligned with the key, the key extends therethrough. The dispenser is releasably coupled against the mounting plate when the key is rotated such that it is not aligned with the aperture through which it extends, thereby holding the housing against the mounting plate.

DETAILED DESCRIPTION

Figure 1:
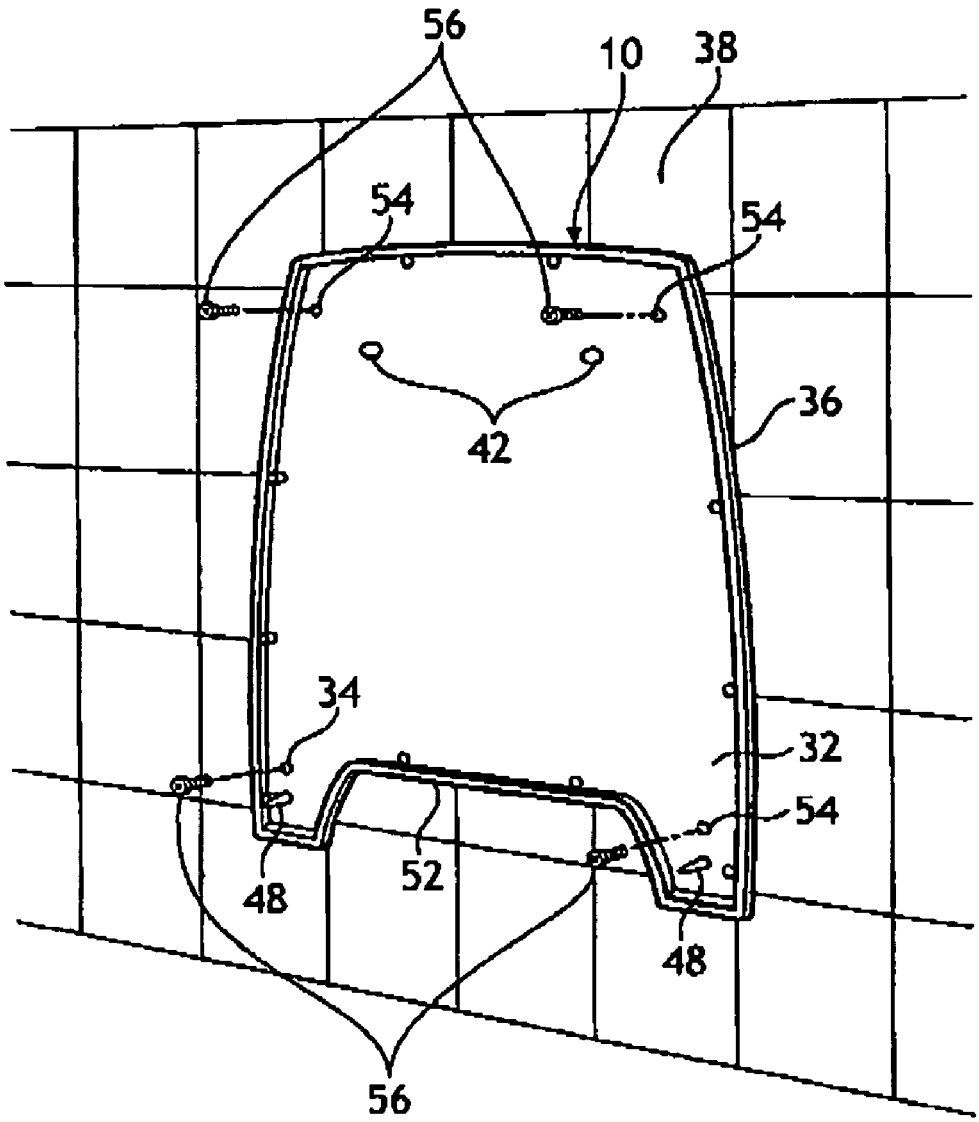
FIG. 1 is a perspective view of a mounting plate of the present invention being coupled to a generally vertical surface.

Reference will now be made in detail to the presently preferred embodiments of the invention, one or more examples of which are illustrated in the drawings. Each example is provided by way of explanation of the invention and is not meant as a limitation of the invention. For example, features illustrated or described as part of one embodiment or figure can be used on another embodiment or figure to yield yet another embodiment. It is intended that the present invention include such modifications and variations.

Many prior art dispensers have not proven to be sufficiently water resistant when an area is washed down via sprayed water and/or liquid cleaning solution which is sprayed with some pressure via a hose and/or other apparatus on dispensers to clean them. In the present invention, a mounting plate and several accessories are provided with, or for, a dispenser, to greatly reduce or eliminate liquid penetration and/or contamination.

Illustrated in FIGS. 1-7 is a mounting plate 10 and a dispenser 12. In this instance, the dispenser 12 dispenses sheet material, but it will be appreciated that the dispenser 10 may dispense any product(s) usually dispensed in a commercial bath room. The dispenser 12 includes a dispenser housing 14, which includes at least a back housing portion 16, a cover 18, and an exit port 19. The back housing portion 16 and the cover 18 cooperate to provide an internal compartment 20 which holds a product, such as, but not by way of limitation, a roll of sheet material, stacks of sheet material, feminine products, diapers, and so forth.

The mounting plate 10 may include several accessories to be used collectively as a kit. These accessories may include a shield 24 (FIGS. 3 and 10), a cover closure 26 (FIGS. 3, 4 and 9A-C) and/or a seal 28 (FIGS. 4 and 11) having indicia 30 thereon. These accessories will be described in further detail below.

The mounting plate 10 and the dispenser 12 may be provided together as a dispensing system as well. There interaction between the mounting plate 10 and the dispenser 12 will be described in detail herein as well. The mounting plate 10 is desirably formed from a resilient material such that the mounting plate 10 seals against the dispenser 12 when the dispenser 12 is positioned against and coupled to the mounting plate 10.

Figure 2:
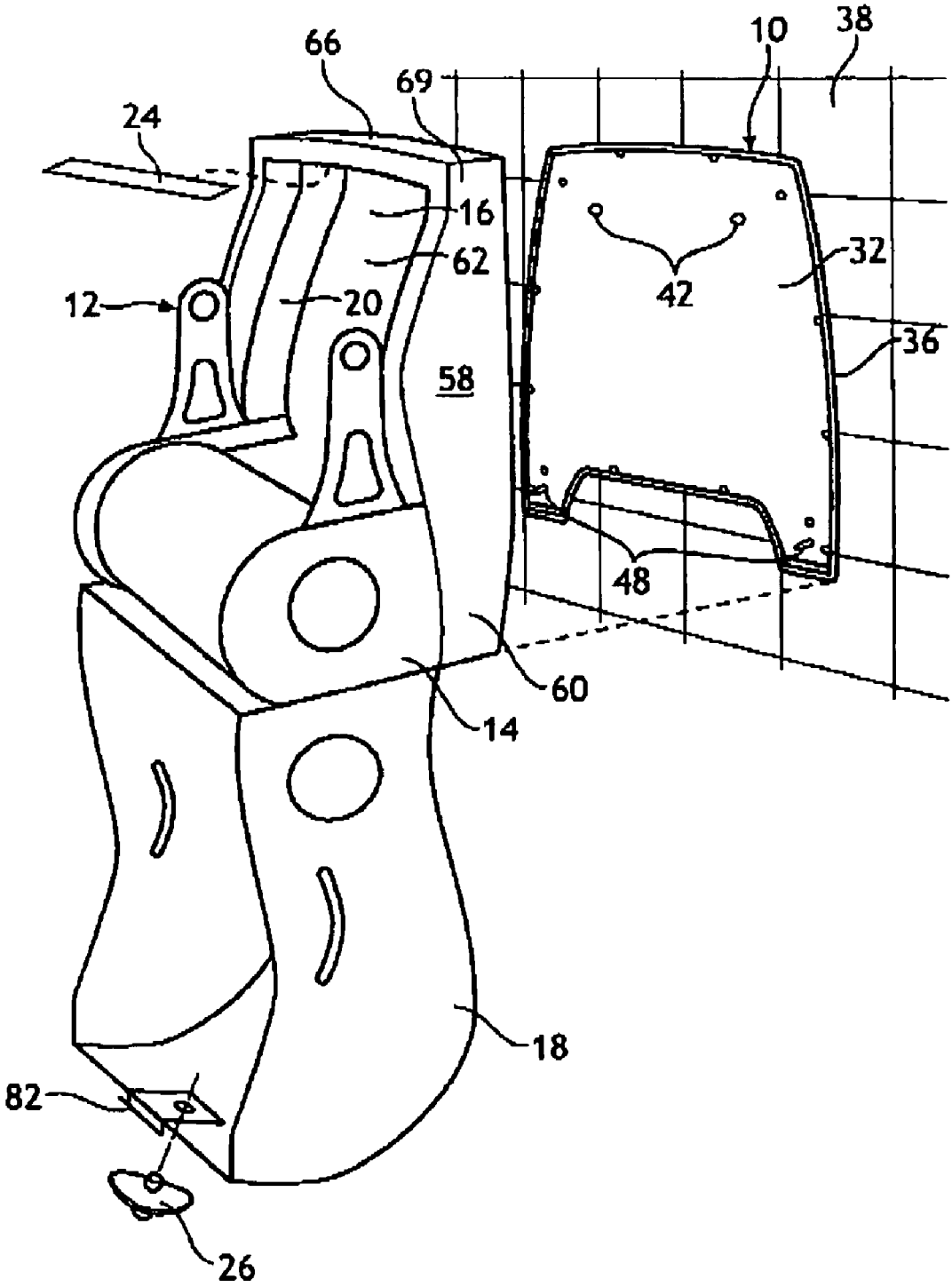
FIG. 2 is a perspective view of a dispenser having a base and a cover, the dispenser positioned in a opened position, a back side of the dispenser being aligned with the mounting plate, along with a shield and cover closure.
Figure 3:
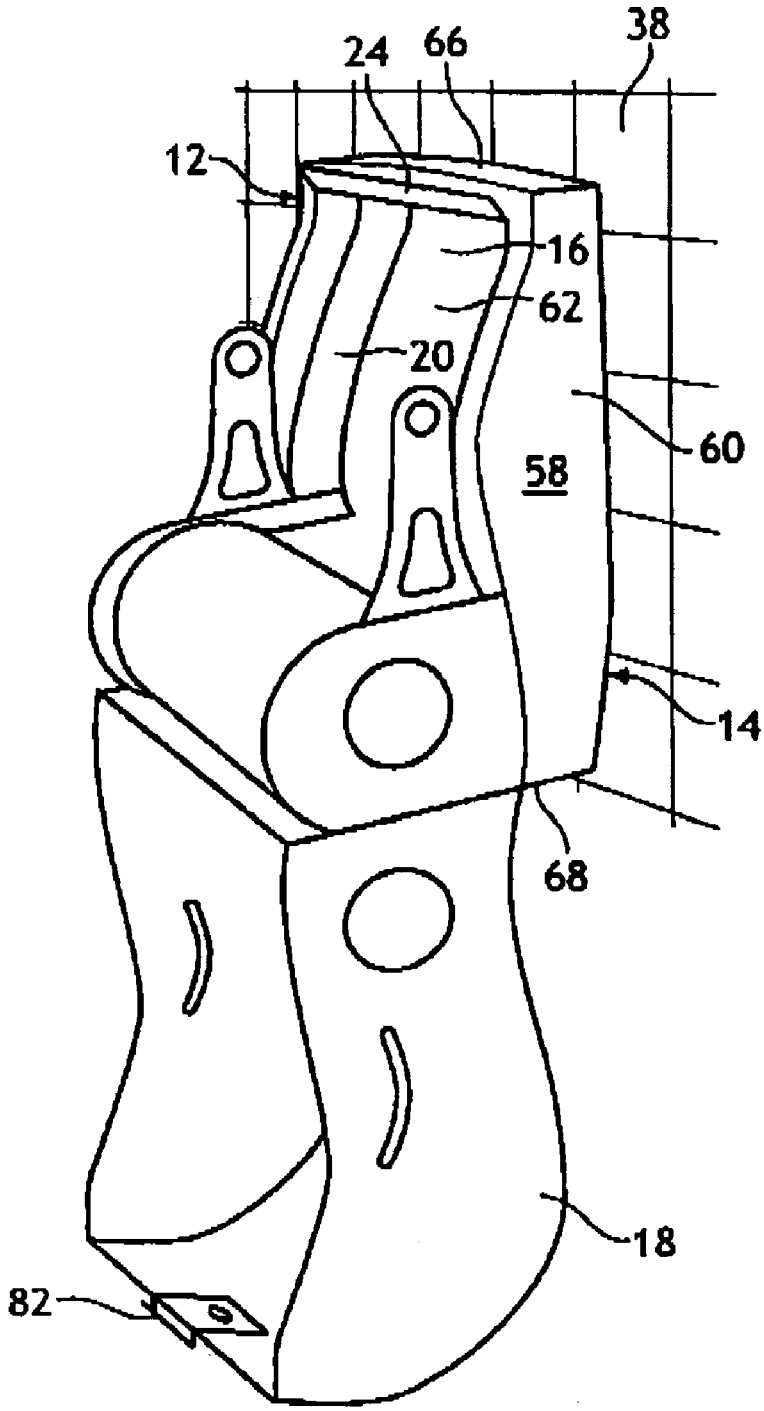
FIG. 3 is a perspective view of the dispenser releasably coupled to the mounting plate, the shield and button closure positioned on the dispenser.

Turning back to the mounting plate 10, as shown in FIGS. 1, 2, 5 and 7A-7C), the mounting plate 10 includes a front surface 32, a back surface 34, and a perimeter edge 36. The back surface 34 is configured to mount to a generally vertical surface 38, such as, for example only, a wall (FIGS. 1-3). The front surface 32 includes a perimeter groove 40 flanked by opposing side walls 41. A pair of spaced-apart keys 42 are rotatably coupled to the front surface 32 of the mounting plate 10 (FIGS. 2, 5, 7A-7C and 8) and extend away therefrom. The keys 42 are provided with a cylindrical body 44 desirably attached at one end to a circular flange (not shown). At the opposite end, the cylindrical body 44 includes a flange portion which provides a key head 46 in axial alignment with the cylindrical body 44. While a pair of keys are used, it will be understood that either one key or a plurality of keys may be utilized.

The front surface also includes a pair of spaced-apart prongs 48 positioned near opposing edges 50 of the perimeter edge 36 near a lower end 52 of the front surface 32 of the mounting plate 10. Each prong 48 desirably includes a tapered end at one end of the prong 48 and a groove (not shown) near an opposite end of the prong 48, adjacent to the mounting plate 10.

A plurality of apertures 54 are provided in the mounting plate 10 to permit it to be coupled to the vertical surface 38 via fasteners 56. Fasteners include, but are not limited to, screws, nails, bolts, and so forth.

Figure 4:
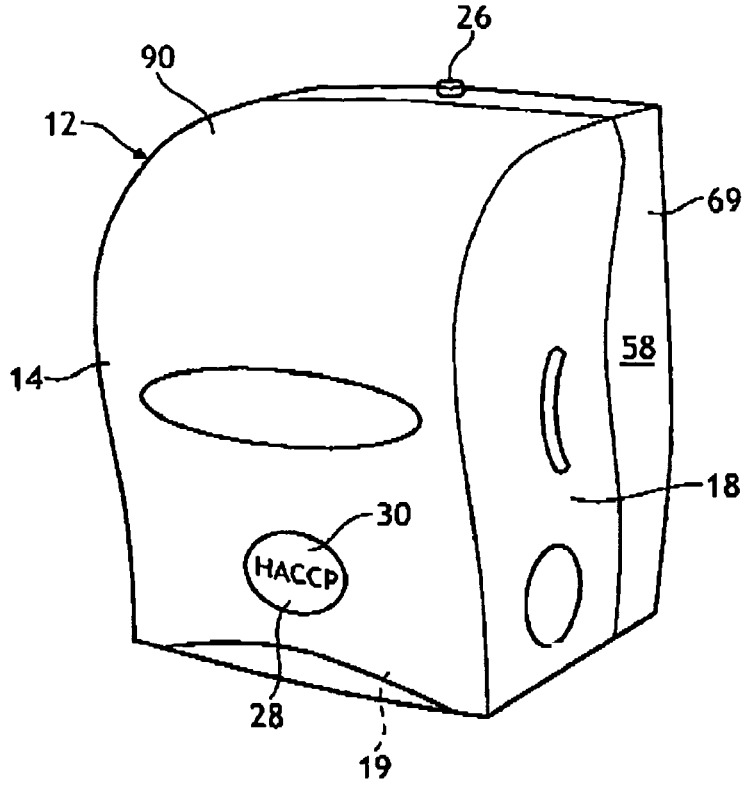
FIG. 4 is a perspective view of the dispenser in a closed dispensing position mounted to the mounting plate, a seal having indicia thereon disposed on a front side of the dispenser.
Figure 5:
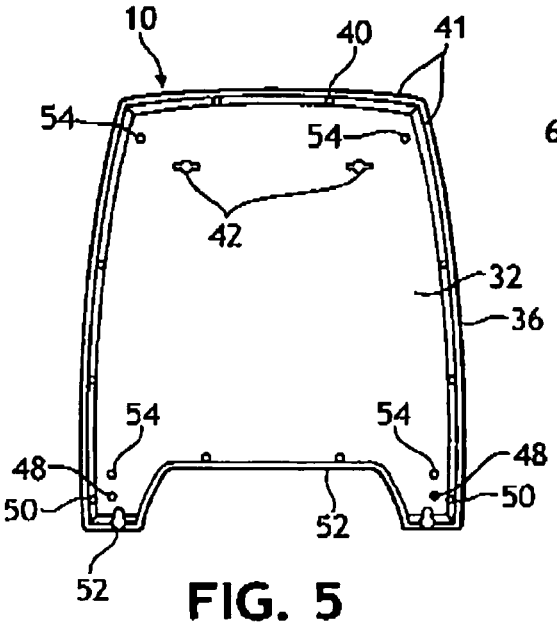
FIG. 5 is a top plan view of the mounting plate.
Figure 6:
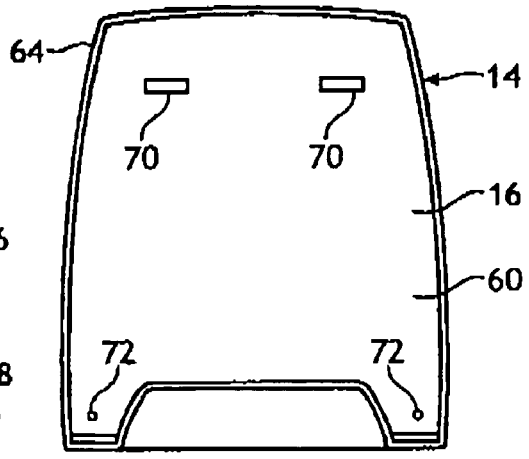
FIG. 6 is a top plan view of a back side of the dispenser showing the back plate portion.
Figure 7C:
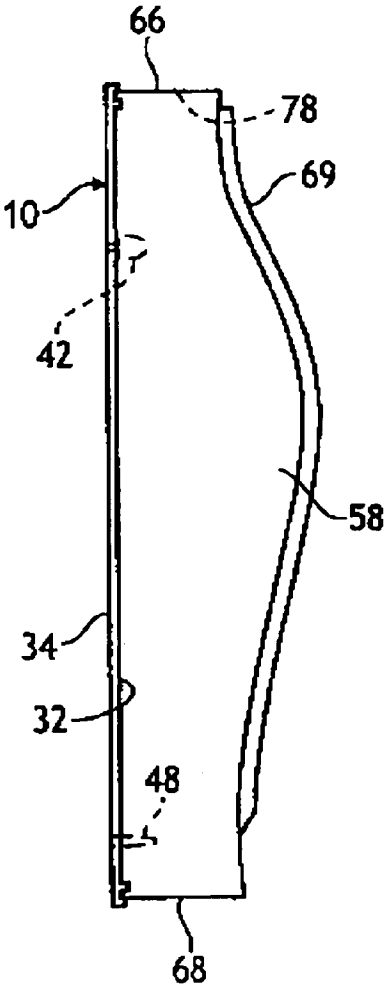
FIG. 7C is a side view of the base of the dispenser and the mounting plate showing the dispenser being mounted against the mounting plate and the keys moved into a non-aligned position relative to the apertures through which they extend, and the prongs on the mounting plate extending through cooperative apertures on the back plate portion.
Figure 7B:
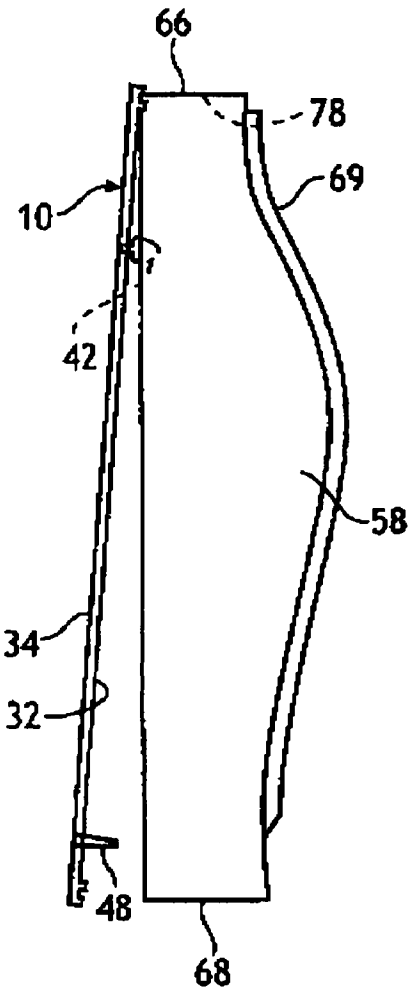
FIG. 7B is a side view of the base of the dispenser and the mounting plate showing an upper portion of the back side of the dispenser being moved against the mounting plate.
Figure 7A:
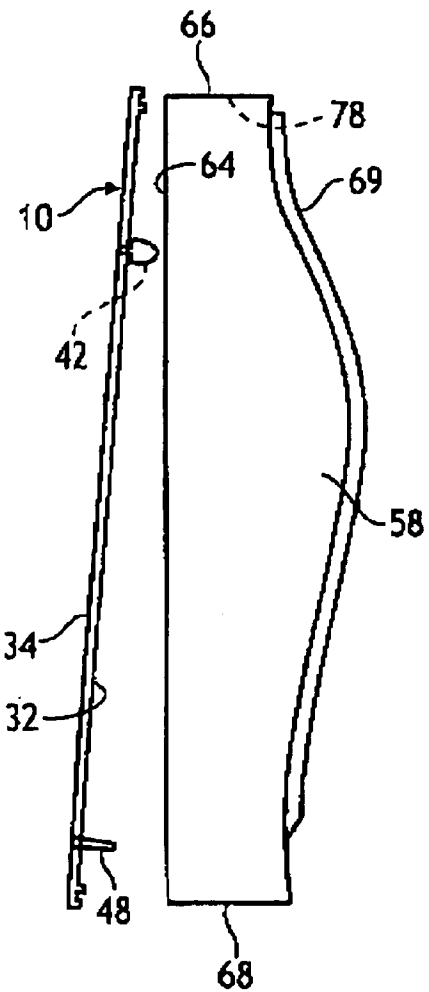
FIG. 7A is a side view of the base of the dispenser and the mounting plate showing the dispenser being aligned with the mounting plate to permit coupling of the dispenser to the mounting plate.
Figure 9A:
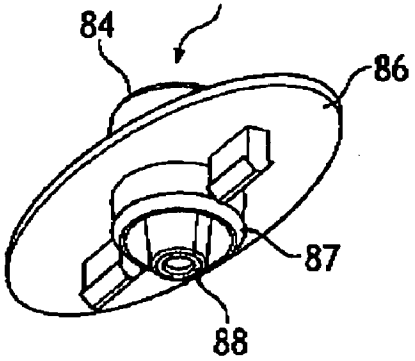
FIG. 9A is a perspective view of a bottom of the cover closure.
Figure 9B:
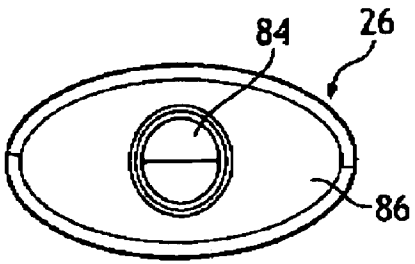
FIG. 9B is a top plan view of the cover closure.
Figure 8:
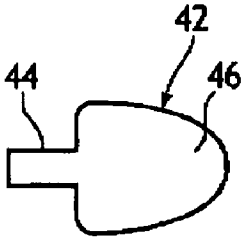
FIG. 8 is a top plan view of a key.

Turning back to the dispenser 12 and housing 14, as shown for illustrative purposes in FIGS. 2-4, a dispenser which dispenses rolled sheet material is provided to be coupled to the mounting plate 10. The dispenser housing 14 includes the cover 18 which, in this illustrative example, is pivotably coupled to a portion of the housing 14, in this instance, the side walls 58. In FIGS. 2 and 3, the housing 14 is illustrated with the cover 18 in the opened position, which permits the housing 14 to be releasably coupled to the mounting plate 10. The back plate portion 16 includes an outer surface 60, an inner surface 62, and a perimeter (not shown). The back plate portion 16 may include a complete wall. Alternatively, however, the back wall portion 16 may include only a partial wall (not shown). In yet another alternative, the back plate portion 16 may include a plurality of wall portions (not shown) positioned generally on a back side of the housing 14.

A perimeter lip 64 may be formed by an edge of the housing defined generally by a back edge of the side walls 58, top wall 66, and/or lower end 68 of the housing 14. A perimeter lip 64 may, alternatively, be formed on the outer surface 60 of the back plate portion 16 near the perimeter. The sidewalls 58, the top wall 66, the lower end 68 and/or the back housing portion 16 may cooperate to provide a base 69 of the housing 14. It will be understood that the location of the perimeter lip 64 is not intended as a limitation. Similarly, the location of the perimeter groove 40 in the mounting plate 10 is not intended as a limitation.

As illustrated in FIGS. 1-4, the back surface 34 of the mounting plate 10 is coupled to the vertical surface 38 by fasteners 56. The perimeter lip 64 is aligned with the perimeter groove 40 of the mounting plate 10. When aligned, the keys heads 46 of the keys 42 are turned to a generally horizontal position to align with horizontal apertures 70 in the back housing portion16 such that at least the key heads 46 of the keys 42 extend through the apertures 70 (FIGS. 2, 3 and 7A-7C). The prongs 48 are also aligned with prong apertures 72 formed in the back housing portion 16 such that each prong 48 extends through its cooperatively positioned prong aperture 72 in the back housing portion 16 (FIGS. 2 and 7A-7C). The back housing portion 16 releasable locks to the prong when a perimeter surrounding each prong aperture 72 extends into the groove (not shown) provided on the prong 48. The perimeter lip 64 is positioned in the perimeter groove 40 to form a seal structure therewith and the housing 14 is coupled to the mounting plate 10 when the key heads 46 are turned in a position out of alignment with the horizontal apertures 70 through which they extend (FIG. 7C), the key heads pressed against the inner surface 62 of the back plate portion 16. To release the housing 14 from the mounting plate 10, the keys are re-aligned in a horizontal position with the horizontal apertures 70 and moved out of the horizontal apertures 70 in the back plate portion 16. This movement also disengages at least a portion of the perimeter lip 64 from the perimeter groove 40. The perimeter of each prong aperture 72 moves out of the groove on each prong 48. Then, the prongs 48 are moved out of the prong apertures 72 in the back plate portion 16. The remainder of the perimeter lip 64 is disengaged from the perimeter groove 40 to un-couple the dispenser 12 from the mounting plate 10.

Figure 10:
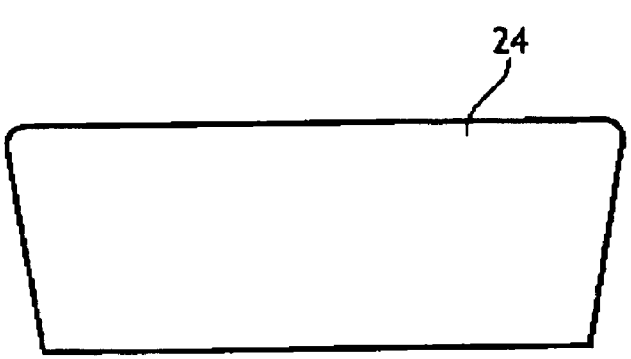
FIG. 10 is a top plan view of the shield.

The dispenser desirably also includes accessories which may assist in reducing or preventing water and/or liquid cleaning solution from entering the dispenser housing 14. Such accessories may include a shield 24 which is positioned on an inner surface 78 of the top wall 66 of the housing 14 (FIGS. 2, 3 and 10). The shield 24 is desirably constructed from a flexible material which conforms to any curves of the inner surface 78 of the top wall 66. The shield 24 is positioned so that water sprayed above the dispenser 12 is inhibited from leaking into the internal compartment 20 of the housing 14 via the closure between the base 69 of the housing 14 and the cover 18. While one shield of a particular configuration is illustrated, it will be appreciated that any number of shields of any configuration may be utilized in any appropriate location on the dispenser and/or the mounting plate to reduce or eliminate the influx of water and/or liquid cleaning solution into the dispenser. The shield 24 may be coupled to the dispenser housing 14 by a bonding material such as, by way of non-limiting example, an adhesive (not shown) disposed on the shield and/or housing 14. Alternatively, the shield may be coupled to the housing via any method known in the art.

The accessories may also include a cover closure 26 adapted to provide an alternative button mechanism to replace the existing button member 82 and/or other latch member (not shown) on the dispenser 12 which permits maintenance personnel to obtain entry into the internal compartment 20 of the dispenser 12 (FIGS. 2, 4 and 9A-9C). Such a cover closure 26 in the present instance may include an upper button member 84 and a flange member 86, which reduces entry of water, solution(s), and so forth into the button member 84 area. The cover closure 80 may also include a lower button member 87 and a latch interface 88 which desirably interfaces with latch mechanisms to permit the dispenser 12 to be opened in an opened loading position, as shown in FIG. 2, and closed, in a closed dispensing position, as shown in FIG. 4. Alternatively, however, it will be appreciated that the cover closure 26 may be formed as an outer cover (not shown) for the existing button member 82 provided with the dispenser. Such accessories may include any other cover closures adapted to close any other openings into the dispenser 12. The cover closure 26 and any other closures (not shown) are desirably formed from a resilient material which is flexible.

Figure 11:
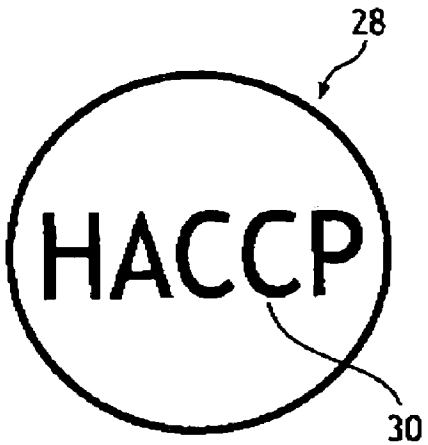
FIG. 11 is a top plan view of the seal, showing indicia thereon.
Figure 9C:
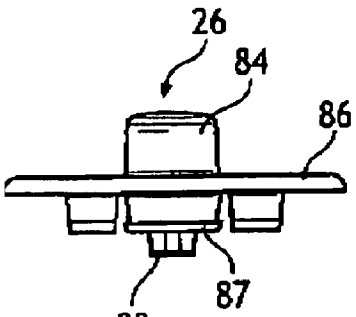
FIG. 9C is a side view of the cover closure.

The accessories may also include a water-resistant seal 28, as shown in FIGS. 4 and 11, which may be disposed on an outer surface 90 of the dispenser 12. The seal 28 desirably may include indicia 30 which may include, but not by way of limitation, information to maintenance personnel that the dispenser 12 has water resistant features and therefore may be washed down as described previously herein. In this instance, the indicia desirably states "HACCP" to indicate that the dispenser supports Hazard Analysis and Critical Control Point (hereinafter "HACCP") procedures at the facility. HACCP is a food safety program adopted by the Food and Drug Administration. HACCP standards are used, for example, in the food industry.

The seal 28 may also desirable state that the indicia 30 may include, but not by way of limitation, information that the dispenser complies with Good Manufacturing Practices. This information designates that the overall dispensing system complies with good manufacturing practices in the manner that is may be cleaned, maintains the product in a clean, non-contaminate state. Further, the dispenser is desirably configured, but not by way of limitation, such that a user does not touch the dispenser itself to obtain the product. It will be appreciated that the indicia may include any number of messages or information.

The kit may include other items, such as, for example, fasteners, and so forth. It will be appreciated that any combination of these accessories may be used in a kit including the mounting plate 10. Further, other and/or additional accessories known to those of skill in the art may be used in the kit.

While certain characteristics are described in specific embodiments, any one or more characteristics, features, and/or elements may be used in any combination in any embodiment, or to create a particular embodiment from the disclosures, teachings, and/or suggestions provided herein. While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. An apparatus adapted for use with a dispenser to render the dispenser water resistant, the dispenser having a housing including a compartment formed therein, an exit port, a perimeter lip, and a back housing portion including at least one aperture therein, the apparatus comprising:

a mounting plate configured to be mounted to a vertical surface, the mounting plate including at least one rotational key extending from the mounting plate, each rotational key being rotatably coupled to the mounting plate, the mounting plate having a perimeter groove, the perimeter groove including opposing side walls, the side walls border both sides of the perimeter groove over the entire length of the perimeter groove, wherein when the dispenser is positioned against the mounting plate the perimeter lip is positioned in the perimeter groove to form a seal structure therewith, the key extends through the aperture in the back housing portion, and the dispenser is releasably coupled against the mounting plate when the key is rotated such that the key is not aligned with the aperture through which the key extends, thereby holding the housing against the mounting plate.

2. The apparatus of claim 1, wherein the mounting plate further includes a front surface and a back surface, and the front surface includes a perimeter groove and opposing side walls which is configured to be positioned against at least a portion of the perimeter lip of the housing, and the back surface is configured to be positioned against a generally vertical surface.

3. The apparatus of claim 2, wherein the key extends away from the front surface of the mounting plate, and wherein the key extends through the aperture in the back housing portion when the housing is aligned with the mounting plate and positioned thereagainst.

4. The apparatus of claim 2, wherein the mounting plate further includes a prong positioned to extend away from the front surface of the mounting plate, and wherein the prong is positioned through an aperture in the back housing portion when the housing is aligned with and positioned against the mounting plate.

5. The apparatus of claim 2, wherein the mounting plate includes a resilient material such that the mounting plate seals against the dispenser when the dispenser is positioned against and coupled to the mounting plate.

6. The apparatus of claim 1, wherein the key includes a key head, and wherein when the key is positioned through the aperture in the back housing portion and rotated, the key head is positioned against a portion of the back housing portion to hold the dispenser against the mounting plate.

7. An apparatus adapted for use with a dispenser to render the dispenser water resistant, the dispenser having a housing including a compartment formed therein, an exit port, and a back housing portion including at least one aperture therein, the apparatus comprising:

a mounting plate configured to be mounted to a vertical surface, the mounting plate including at least one rotational key extending from the mounting plate, each rotational key being rotatably coupled to the mounting plate, wherein when at least a portion of the back housing portion of the dispenser is positioned against the mounting plate, the key is positioned to extend through the aperture in the back housing portion, and the dispenser is releasably coupled against the mounting plate when the key is rotated such that the key is not aligned with the aperture through which the key extends, thereby holding the housing against the mounting plate and the mounting plate further comprises a perimeter groove having opposed side walls, the side walls border both sides of the perimeter groove over the entire length of the perimeter groove, the perimeter groove is configured to receive a perimeter lip provided by the housing of the dispenser.

8. The apparatus of claim 7, wherein the perimeter lip and the perimeter groove mate to form a seal when the housing of the dispenser is aligned and positioned against the mounting plate and coupled thereto via rotation of the key.

9. The apparatus of claim 7, wherein the mounting plate further includes a front surface and a back surface, and the front surface is configured to be positioned against at least a portion of the housing and the back surface is configured to be positioned against a generally vertical surface.

10. The apparatus of claim 9, wherein the key extends away from the front surface of the mounting plate.

11. The apparatus of claim 9, wherein the key extends through the aperture in the back housing portion when the housing is aligned with the mounting plate and positioned thereagainst.

12. The apparatus of claim 9, wherein the mounting plate further includes a prong positioned to extend away from the front surface of the mounting plate.

13. The apparatus of claim 12, wherein the prong is positioned through an aperture in the back housing portion when the housing is aligned with and positioned against the mounting plate.

14. The apparatus of claim 9, wherein the mounting plate includes a resilient material such that the mounting plate seals against the dispenser when the dispenser is positioned against and coupled to the mounting plate.

15. The apparatus of claim 9, wherein the key includes a key head.

16. The apparatus of claim 15, wherein when the key is positioned through the aperture in the back housing portion and rotated, the key head is positioned against a portion of the back housing portion to hold the dispenser against the mounting plate.

17. A kit adapted for use with a dispenser to render the dispenser water resistant, the dispenser having a housing including a compartment formed therein, an exit port, and a back housing portion including at least one aperture, the kit comprising:

at least a mounting plate configured to be mounted to a vertical surface, the mounting plate including at least one rotational key extending from the mounting plate, each rotational key being rotatably coupled to the mounting plate, wherein when the dispenser is aligned and positioned against the mounting plate the key extends through an aperture in the back housing portion, and the dispenser is releasably coupled against the mounting plate when the key is rotated such that the key is not aligned with the aperture through which the key extends, thereby holding the housing against the mounting plate and the mounting plate further comprises a perimeter groove having opposed side walls, the side walls border both sides of the perimeter groove over the entire length of the perimeter groove, the perimeter groove is configured to receive a perimeter lip provided by the housing of the dispenser, and wherein the perimeter lip and the perimeter groove mate to form a seal when the housing of the dispenser is aligned and positioned against the mounting plate.

18. The kit of claim 17, wherein the mounting plate further includes a front surface and a back surface, and the front surface is configured to be positioned against at least a portion of the housing and the back surface is configured to be positioned against a generally vertical surface.

19. The kit of claim 18, wherein the key extends away from the front surface of the mounting plate, and wherein the key extends through the aperture in the back housing portion when the housing is aligned with the mounting plate and positioned thereagainst.

20. The kit of claim 18, wherein the mounting plate further includes a prong positioned to extend away from the front surface of the mounting plate, and wherein the prong is positioned through an aperture in the back housing portion when the housing is aligned with and positioned against the mounting plate.

21. The kit of claim 18, wherein the key includes a key head, and wherein when the key is positioned through the aperture in the back housing portion and rotated, the key head is positioned against a portion of the back housing portion to hold the dispenser against the mounting plate.

22. The kit of claim 17, wherein the kit further comprises a shield positioned in a portion of a dispenser adapted to shield water away from contents in the compartment of the dispenser.

23. The kit of claim 17, further comprising a cover closure to prevent water from entering the compartment of the dispenser.

24. The kit of claim 23, wherein the cover closure includes a cover closure for a button.

25. The kit of claim 17, further comprising a seal having indicia thereon.

26. The kit of claim 25, wherein the indicia designates compliance with HACCP standards.

* * * * *